United States Patent [19]

Marty et al.

[11] Patent Number: 4,601,874

[45] Date of Patent: Jul. 22, 1986

[54] PROCESS FOR FORMING A TITANIUM BASE ALLOY WITH SMALL GRAIN SIZE BY POWDER METALLURGY

[75] Inventors: Michel Marty, Buc; Henri Octor, Bagneux; André Walder, L'Hay les Roses, all of France

[73] Assignee: Office National d'Etudes et de Recherche Aerospatiales (ONERA), France

[21] Appl. No.: 752,512

[22] Filed: Jul. 8, 1985

[30] Foreign Application Priority Data

Jul. 6, 1984 [FR] France ..... 84 10829

[51] Int. Cl.[4] ..... B22F 1/00

[52] U.S. Cl. ..... 419/23; 419/26; 419/30; 75/245; 148/11.5 P; 148/11.5 F; 148/126.1; 148/133; 420/417

[58] Field of Search ..... 420/417; 148/126.1, 148/133, 11.5 P, 11.5 F; 75/245; 419/23, 26, 30

[56] References Cited

U.S. PATENT DOCUMENTS

| | | | |
|---|---|---|---|
| 3,181,947 | 5/1965 | Vordahl | 75/206 |
| 4,134,758 | 1/1979 | Nagai et al. | 148/133 |
| 4,219,357 | 8/1980 | Yolton et al. | 419/55 |

FOREIGN PATENT DOCUMENTS

| | | |
|---|---|---|
| 1600154 | 8/1970 | France . |
| 2091242 | 1/1972 | France . |
| 887922 | 1/1962 | United Kingdom . |

*Primary Examiner*—Stephen J. Lechert, Jr.
*Attorney, Agent, or Firm*—Larson and Taylor

[57] ABSTRACT

A process for forming a titanium base alloy comprises compacting a powder formed of particles of titanium or of a mother alloy thereof and of a dispersion of fine particles of a product curbing the growth of the grain size, in a proportion per volume which is less than that which would lead to the formation of a continuous layer of fine particles about the particles of titanium powder. Then the alloy is heat treated at a temperature higher than the point of transformation into phase $\beta$ and quenched. The product is typically selected among S, P, B, As, Se, Te, Y and the lanthanides.

6 Claims, 10 Drawing Figures

PROCESS FOR FORMING A TITANIUM BASE ALLOY WITH SMALL GRAIN SIZE BY POWDER METALLURGY

FIELD OF THE INVENTION

The invention relates to a process for forming a titanium base alloy having a small grain size, the term "alloy" being intepreted as extending to a product only containing, in addition to titanium, additional elements in a proportion sufficiently small for the phase $\alpha \rightarrow \beta$ transformation to subsist.

BACKGROUND OF THE INVENTION

Titanium, pure and especially in the form of a titanium base alloy, has properties of lightness, mechanical strength and high temperature resistance which explain that its use is increasing in numerous technical fields, particularly for aircraft construction. As a rule, titanium parts are formed by powder metallurgy. Titanium powder containing additional elements is used. The part is densified by drawing, or isostatic compression and a heat treatment is carried out. Up to now it has been felt preferable to carry out the heat treatment at a temperature lower than the point of transformation to phase $\beta$, for beyond this point there is an excessive increase in size of the metallurgical grains, which increase detrimentally affects mechanical properties, for example the ductility and tensile strength of the product obtained, even after a partial return from the single $\beta$ phase to a $\alpha$ phase during cooling to ambient temperature after the heat treatment.

On the other hand, operating at a temperature lower than the transformation point means waiving the advantages offered by the acicular type structure associated with the partial transformation of phase $\beta$ obtained at high temperature to phase $\alpha$. Such advantages include improved resistance to sudden propagation of cracks (i.e. the tensile strength of the alloy), to the propagation of fatigue cracks, to creep, to corrosion under tensile stress in salt water.

SUMMARY OF THE INVENTION

The invention is based on the finding that the harmful influence of a temperature higher than the transformation point is not inherent to the acicular structure, but is related to the size of the $\beta$ grains, which increases very rapidly at high temperature until it reaches and possibly exceeds 0.5 mm, and leads, after the final quenching, to a structure whose grain size (ex $\beta$ grain) depends directly on the size obtained at the end of the heat treatment.

The problem exists also for certain so-called "almost alpha" titanium alloys in which treatment in $\beta$ phase is frequently used and leads to an excessive size increase of the metallurgical grain.

Another prior art process (British Pat. No. 928,407) for forming a titanium based alloy comprises the steps of compacting a powder formed of particles of titanium or of mother alloy thereof, heat treating at a temperature higher than the point of transformation into phase $\beta$ and quenching. But the additions are made in proportions and in a form such that they cannot block the size increase of the grains.

It is an object of the invention to provide a process for forming an improved base alloy, more especially in that it provides the advantages associated to a high temperature heat treatment, while avoiding the exaggerated increase in grain size in phase $\beta$, which increase is harmful to the mechanical properties.

According to the invention, there is provided a process of the above-defined type, wherein the powder further contains a dispersion of fine particles of a product curbing the growth of the grain size, in a proportion per volume less than that which would lead to the formation of a continuous layer of particles about the particles of titanium powder, said product particles being present at the surface of the titanium grains in the alloy obtained.

The product will be selected among elements, compounds or mixture of a species chemically stable with respect to titanium and having at least one element which has a very low solubility in titanium, if any. The additional species or substance may be stable during elaboration, or be transformed by reaction with the elements of the alloy.

It may be thought, while the complete and strict character of this explanation should not be considered as a condition for validity, that two phenomena intervene for limiting the grain size.

A first action consists of blocking of the $\beta$ grains by fine particles of the substance which remain stable or are transformed during elaboration, distributed over the periphery of the other powder particles. The metallurgical grains appearing during passage to phase $\beta$ then coincide with the particles of the original powder.

A second action is formed by curbing of the migration of the $\beta$ grain joint during heat treatment. In this case, particles of the addition product, stable or transformed, are inside the $\beta$ metallurgical grains which are then larger than the initial powder grains, but remain smaller than the metallurgical grains in reference samples free of the addition product. That result is obtained even with very low contents of addition product and this is a very favorable factor to the extent that the use of an addition product may render the alloy more brittle.

The two above phenomena have been observed, one or other being possibly present alone or preponderant for certain addition production or for certain ranges of content.

It may be noted that finding a product suitable for use in fine particle and fulfilling the required function appeared a very remote possibility, due to high reactivity of titanium with respect to chemical substances, however known as difficult to decompose. For example, silica, tantalum carbide and alumina are rapidly dissolved at temperatures close to 1000° C., i.e. close to the point of transformation to phase $\beta$.

However, the examination of the free enthalpy of formation of some oxides, and more especially of rare earth oxides, reveals values at 1000° C. sufficient to give hope of the possibility of obtaining favorable results. Likewise, examination of the properties of different elements frequently used in metallurgy shows a sufficiently low solubility for complying with the required conditions. In fact, different oxides and more especially $Y_2O_3$ and $Dy_2O_3$ have been found acceptable.

Metalloids in elementary form or in the form of compounds, have also been used, more especially boron, BN, B4C, B4Si, S6Si and LaB6. Sulphur, WS, MoS2, Zns may also be contemplated, as well as phosphorus, the latter however requiring special precautions because of its high inflammability. Elements may also be used from colmns 5 and 6 of the periodic table which are related to S and P (Se, Te, As). All these elements have low solubility in titanium.

Satisfactory results are obtained if different conditions are complied with concerning the starting powder (prealloyed particles of mixture), the addition product and heat treatment.

These conditions will now be discussed, with reference more especially to the particularly interesting case of the titanium alloy named TA6V, comprising 6% by weight of aluminium and 4% of vanadium.

The prealloyed (or titanium and addition element) particles are advantageously formed by a process giving rise to approximately spherical particles, with an even and fine grain size, the size of the particles conditioning that of the grains. A grain size range of from 40 to 300 microns will be generally acceptable.

Prealloyed titanium powders may more especially be used obtained by pulverization using a rotary electrode process, at present well known and widely used for elaborating titanium alloy powders.

The median value of the diameter of TA6V Alloy particles obtained by this process is of the order of 160 μm. The fraction retained may be limited as much as desired by screening.

The essential criterion of the choice of the initial particles of the addition product used for curbing the growth of the grain is the dimensional stability. This dimensional stability may be obtained if the addition product used is chemically stable in the presence of the titanium alloy. However, this condition is not indipensable. There may be a reaction and chemical transformation of the particles without there being dissolution in the metal matrix. One of the factors which oppose this dissolution is the very low solubility in titanium of an element entering in the composition of the initial particle and experience has proved that this factor is preponderant.

So the following substances may be used:

compounds having great chemical stability with respect to titanium, i.e. especially the oxides having a free formation enthalpy less than that of alumina, in particular the compounds of the lanthanide family such as lutetium oxide, neodynium oxide, dysprosium oxide;

compounds containing at least one element having a very low solubility in titanium, i.e. more especially those mentioned above and whose solubilty in titanium is (in percentage by weight):

| | | |
|---|---|---|
| S | 0.02 | at 790° C. |
| P | 0.007 | |
| B | 0.067 | |
| As | 0.26 | |
| Se | 0.25 | |
| Te | 0.47 | |
| Y | 0.37 | at 900° C. |

The most favorable addition product concentration range depends on numerous factors, among which the grain size of the particles and that of the starting powder. It may be determined by experiment for each particular product used. However, the volume concentration C of the particles of the addition product will as a general rule have to be maintained between two values, which correspond one to the formation of a continuous layer of particles on the alloyed titanium powder grains (layer which could lead to making the alloy brittle by decoherence, at the boundary of the primitive powder grains), the other to an excessive spacing apart of the particles of the addition product at the surface of the metal powder grains.

Assuming the particles spherical, and if we designate by:

d the average diameter of the particles of the addition product, l the center-to-center distance of the particles of the addition product, D the average diameter of the alloy powder particles, the coating of the addition product will in general be effective for:

$$d < l \leqq 5d$$

Now, in the case of spherical particles $$C = \frac{\pi}{4} \frac{d^3}{Dl^2}$$

which leads, for a mean value of D equal to 100 microns which may be considered as typical, to:

$$\pi d 10^{-4} \leqq C < 7.85 d \cdot 10^{-3}$$

In this formula, C is a number without dimension, d is in microns.

This criteriom will lead for example to the following ranges, expressed in vpm (volume per million)

$B$ with $d = 0.2$ μm: 63 vpm $\leqq C <$ 1570 vpm $Y_2O_3$ with $d = 2$ μm: 630 vpm $\leqq C <$ 15.700 vpm The grain size distribution of the initial particles of the addition product acts on the proportion C to be adopted. It will be appreciated that the use of initial particles which are too large leads to introducing a high proportion, harmful to the mechanical properties to the alloy, more especially its ductility. In practice, a grain size of the particles less by two orders of magnitude or more than that if the titanium powder generally gives good results.

A reduction of the grain size of the initial particles of the addition product, with a constant concentration C, causes a reduction of the distance between particles l and so a greater efficiency in limiting the size of grain $\beta$. This result has more especially been noted by comparing the grain sizes obtained with boron of a grain size of about 0.2 micron and with ceramic type particles, such as yttrine $Y_2O_3$, for which the grain size is about 2 microns.

The heat treatment temperature has little influence on the results obtained. A temperature greater by about 50° C. then the point of transformation is generally satisfactory. When, for example, it is desired to elaborate the TA6V alloy for which the $\alpha+\beta/\beta$ transformation point is between 995° C. and 1000° C., maintaining a temperature between 1050° C. and 1100° C. for one hour before quenching is satifactory.

The process of the invntion may be put into practice with a view to obtaining different results but all related to the possibility of keeping a reduced grain size despite exceeding the temperature of transformation into phase $\beta$.

First of all, as has already been mentioned, the process of the invention allows the size of grain to be controlled and, consequently, that of the alloy grain after quenching. This size in fact depends in practice only on the grain size of the original powder. Combinations of mechanical properties may consequently be obtained which take advantage of the beneficial effects of the acicular structures, while avoiding the handicap of a grain $\beta$ which is too large.

The process of the invention also allows homogeneization of an alloy to be accelerated, without an unfavorable effect on its final mechanical properties. The diffusion coefficient of an element in an alloy is in fact an increasing function of the temperature, which shows the advantage of working at as high a temperature as possible so as to obtain rapid homogeneization. In addition, in the case of a titanium matrix the diffusion coefficient of numerous elements undergoes an appreciable discontinuity, in the direction of an increase, if at a fixed temperature the phase-$\alpha$ is transformed into phase $\beta$. Thus, homogeneization of an alloy containing particles enriched with an alpha phase stabilizing element such as aluminium, oxygen, carbon, nitrogen will be accelerated if the treatment temperature exceeds that at which the particle in question goes wholly over to phase $\beta$. Particles of this kind, as well as inclusions of elements foreign to the alloy, may be met with in products obtained by powder metallurgy processes.

Despite its advantage in this case, a treatment of homgeneization cannot however be contemplated at a temperature greater than the point of transformation into phase $\beta$ in the absence of an addition product, for it leads to an unacceptable increase in size of gran $\beta$. The invention overcomes this drawback. In addition, compared with high temperature annealing of the powder before densification, it offers the advantage of allowing an exchange of elements between different powder granules by solide state diffusion.

Among the situations in which acceleration of the homogeneization process is of great advantage, the following may be mentioned by way of example.

Improvement to the chemical homogenity of alloys:

This effect is of particular interest in recovering machining shavings of alloyed titanium when this recovery comprises transformation into powder. The machining shavings are contaminated by oxygen, nitrogen, carbon and particles foreign to the alloy. The average level of contamination may be lowered by mixing, with the powdered and screened shavings, powder having a lower content of interstitial elements. This operation further reduces the size of the most harmful particles. In practice, crushing of hydrided shavings allows particularly fine powders to be obtained, down to about 40 microns. After mixing these powders with addition product particles and after densification, a high temperature homogeneization treatment improves the quality of the finished products, without an exaggerated increase in the size of grain $\beta$.

Alloy synthesis by sintering a mixture of fine parts of titanium sponge and mother alloy powder:

This solution, economically attractive, has the drawback of leading, when it is put into practice by present days techniques, to products containing chlorine originating from the titanium sponge. The result is a metallurgical structure which has great stability during the heat treatments but whose porosity cannot be completely closed by isostatic pressing. The fatigue resistance of these products is considerably reduced thereby. The elimination of chorine from the final parts of the sponge causes an exaggerated increase in size of grain $\beta$ during homogeneization of the alloy at a temperature greater than the $\beta$ transus. These products may be improved by using the process of the invention, for this latter allows the diffusion and isostatic pressing in the $\beta$ range to be affected without ann exaggerated increase in the size of the metallurgical grain, whence homogeneization and closure of the pores.

This technique may be combined with the preceding one: it allows a starting mixture to be used comprising powders elaborated from shavings with a high oxygen, nitrogen and carbon content, fine titanium sponge parts and mother alloy powder, these latter components being but slightly charged with interstitial elements.

Solving elements such as Si or Ge whose solubility in phase $\beta$ increases rapidly with the temperature:

Different embodiments will now be described, corresponding to the elaboration of TA6V titanium alloy by powder metallurgy.

SHORT DESCRIPTION OF THE DRAWINGS

FIGS. 1 to 10 are simplified reproductions of micrographics of alloys obtained after heat treatment and quenching, the continuous lines showing the grain boundaries and the broken lines (where present) indicating the limits of original particles, when they do not coincide with the $\beta$ grain boundaries.

DETAILED DESCRIPTION OF EXAMPLES

In all cases, the starting powder was obtained by crushing TA6V alloy using an arc process in a neutral gas with a rotating electrode and screening to a grain size less than 160 microns.

Several contents of initial particles, equal to or less than 2200 vpm, were tested. The same metallurgical treatments were applied to the mixture containing the addition product and to a reference sample of alloy powder. The treatments carried out included densification by isostatic compression under typical conditions, i.e. at a temperature less than the transformation point of the TA6V, or by drawing, then treatment for an hour above the transformation temperature, followed by quenching.

EXAMPLE 1

0.16 g of boron powder having a grain size of about 0.2 micron was added to 1 kg of TA6V alloy powder screened to a grain size less than 160 microns. The proportion thus obtained was 300 vpm. Mixing was carried out in a rotary mixer with glass balls, of the "TURBULA" type, for four hours. The mixture was degassed at high temperature in a secondary vacuum and as a thin bed, in accordance with a well known powder metallurgy process. It was then placed in a soft steel case of a shape corresponding to that of the piece to be obtained. The case was sealed under a secondary vacuum by electron beam welding. The alloy was densified by hot isostatic pressing at 950° C. under 1000 bars for three hours. The case was removed by machining or chemical etching. Finally, heat treatment was effected at 1050° C. for one hour and followed by quenching in water.

The same operations were also performed on a reference sample containing only TA6V alloy powder.

Figure 1:
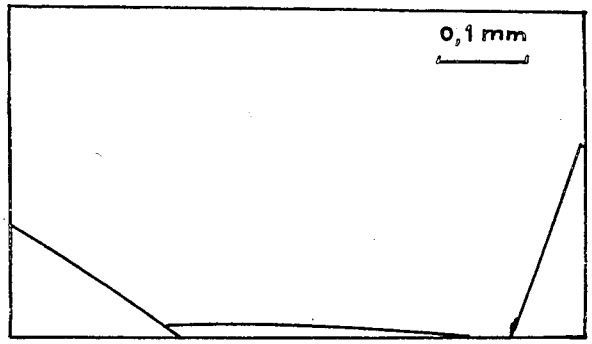
Figure 2:
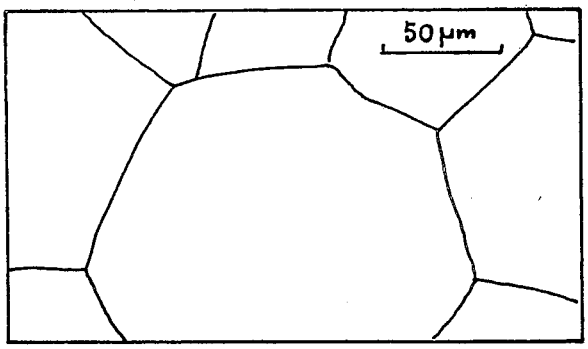

FIG. 1 shows a fraction only of three adjacent grains in the reference sample having undergone all the treatments. A comparison with FIG. 2, which corresponds to the case of the sample containing 300 vpm of boron, shows that there is completely blocking of the joints of grain $\beta$ and maintenance of a very fine grain size. It is essential to note that the optical magnification is not the same in FIGS. 1 and 2.

EXAMPLES 2 AND 3

Figure 3:
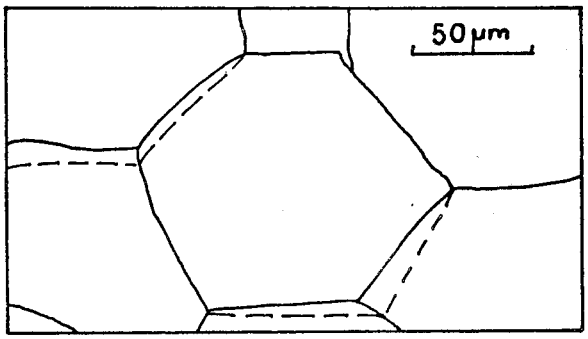
Figure 4:
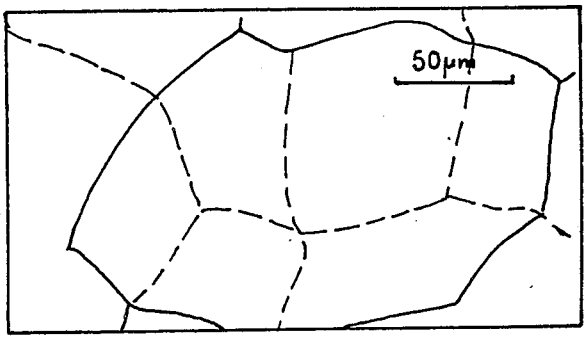

The same treatments as in Example 1 were carried out with boron proportions respectively of 200 vpm and 100 vpm. FIGS. 3 and 4 show the grain sizes obtained. It can be seen in FIG. 3, which corresponds to a proportion of 200 vpm, that substantial blocking of the grain joints is obtained. The boundaries of grains $\beta$, in most cases, coincide with the limits of the old particles (shown with broken lines where there is absence of coincidence).

FIG. 4 shows that a proportion of 100 vpm further appreciably curbs the growth of grain $\beta$, whose size remains very less than that of the reference sample.

EXAMPLES 4, 5, 6 and 7

The same metallurgical treatment was applied to samples containing respectively 400, 500, 1100 and 2200 vpm of boron. In all cases, complete blocking of the grain joints was obtained.

EXAMPLES 8 AND 9

Figure 5:
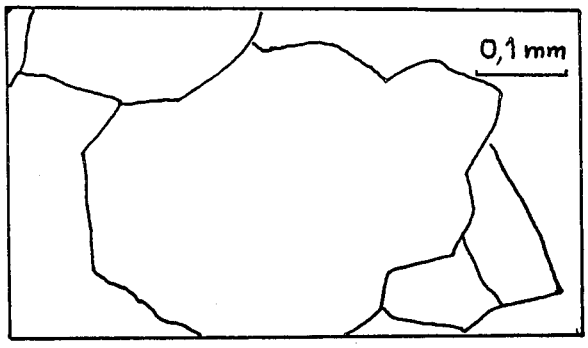
Figure 6:
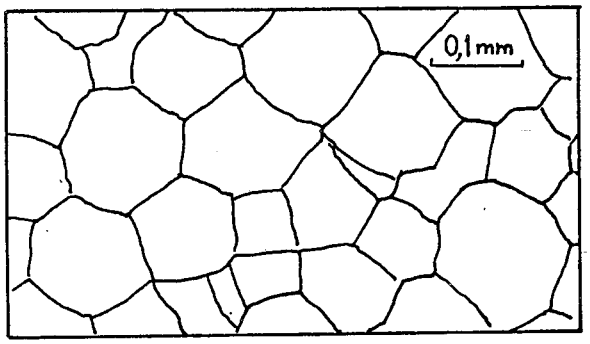

The same metallurgical treatment as in the preceding examples was effected on samples containing respectively 550 vpm and 1100 vpm of dysprosine $Dy_2O_2$. The results obtained are shown in FIGS. 5 and 6. In FIG. 5, corresponding to a proportion of 550 vpm, curbing of the grain boundaries can be seen limiting the growth of grains $\beta$. In FIG. 6, for a proportion of 1100 vpm, complete blocking appears, the limit of the grains $\beta$ containing with the limits of the old particles.

EXAMPLES 10, 11 AND 12

Figure 7:
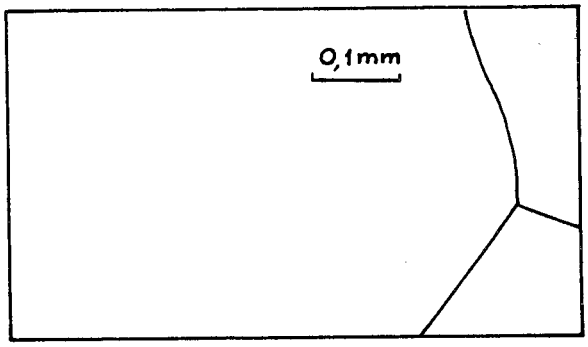
Figure 8:
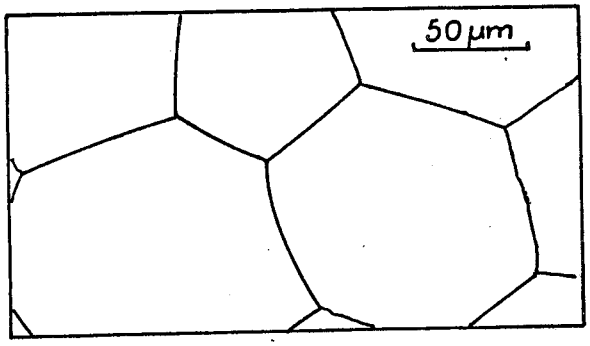
Figure 9:
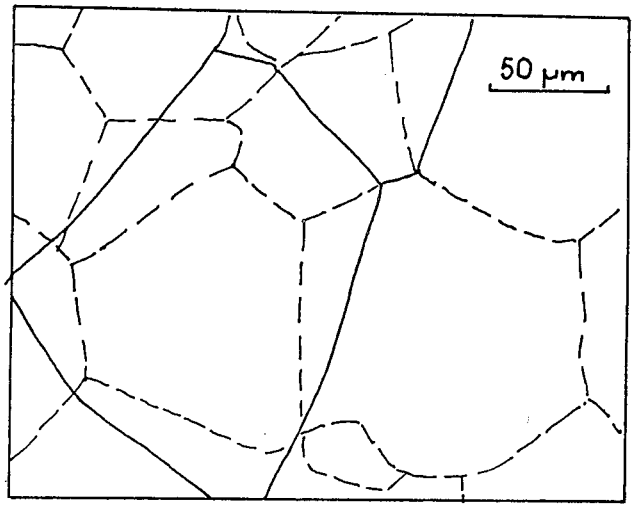
Figure 10:
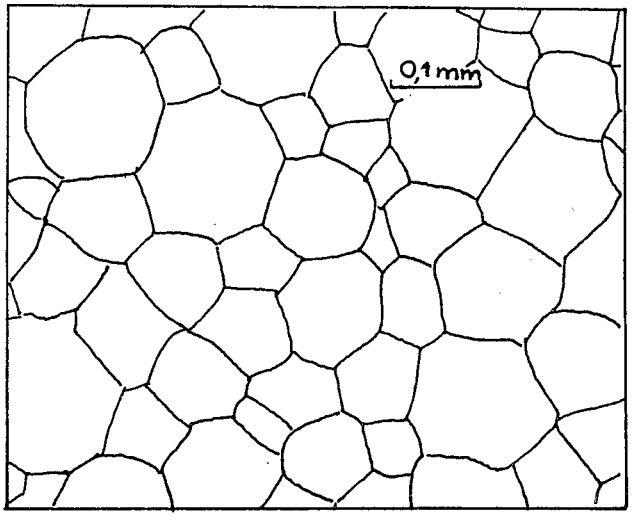

The same heat treatment as in the preceding case, except that the temperature was kept at 1100° C. instead of 1050° C., was applied to a reference sample (FIG. 7), to a sample with 550 vpm of $Dy_2O_3$ (see FIG. 8), to a sample with 550 vpm of $Dy_2O_2$ (FIG. 9) and to a sample with 1100 vpm of $Dy_2O_3$ (FIG. 10).

Blocking of the $\beta$ boundaries can be seen for 1100 vpm $Dy_2O_3$ and 550 vpm of $Y_2O_3$, and appreciable curbing for 550 vpm of $Dy_2O_3$.

The above results and additional results are summed up in the following table, in which it should be noted that the less favorable results obtained with $B_6Si$ seen to be due to an insufficient homogeneous distribution of the addition product in the mixture.

| | B | $Y_2O_3$ | $Dy_2O_3$ | $WS_2$ | $B_6Si$ |
|---|---|---|---|---|---|
| 2200 vpm | Blocking | blocking | blocking | Blocking | Quasi-blocking |
| 1100 vpm | Blocking | Blocking | Blocking | Curbing | Curbing |

-continued

| | B | $Y_2O_3$ | $Dy_2O_3$ | $WS_2$ | $B_6Si$ |
|---|---|---|---|---|---|
| 550 vpm | Blocking | Blocking | Curbing | Curbing | Curbing |
| 400 vpm | Blocking | Curbing | | | |
| 300 vpm | Blocking | | | | |
| 200 vpm | Quasi-blocking | | | | |
| 100 vpm | Curbing | | | | |
| 50 vpm | Curbing | | | | |

We claim:

1. A process for forming a titanium base alloy having a small grain size, comprising the steps of compacting a powder formed of particles of titanium or of mother alloy thereof, heat treating at a temperature higher than the point of transformation into phase $\beta$ and quenching wherein the powder further contains a dispersion of fine particles of a product curbing the growth of the grain size, in a proportion per volume less than that which would lead to the formation of a continuous layer of fine particles about the particles of titanium powder, said product particles being present at the surface of the titanium grains in the alloy obtained.

2. A process according to claim 1, wherein the product is selected among the group consisting of those species chemically stable with respect to titanium.

3. A process according to claim 1, wherein the product is selected among those chemical species which have at least one element which has a very low solubility in titanium at the temperature of heat treatment.

4. A process for forming a titanium base alloy having a small grain size, comprising the steps of compacting a powder formed of particles of titanium or of mother alloy thereof, treating at a temperature higher than the point of transformation into phase $\beta$ and quenching wherein the powder further contains a dispersion of fine particles of a product curbing the growth of the grain size, in a proportion per volume less than that which would lead to the formation of a continuous layer of fine particles about the particles of titanium powder, said product particles being present at the surface of the titanium grains in the alloy obtained, wherein said product is selected from the group consisting of S, P, B, As, Se, Te, Y and lanthanides, as an element and as a compound.

5. A process according to claim 1, wherein said fine particles of said product have a grain size lower by at least two orders of magnitude to the grain size of the particles of titanium.

6. A process according to claim 1 for manufacturing a TA6V alloy, wherein said heat treatment is carried out at a temperature higher than the point of transformation to $\beta$ phase by about 50° C. and is followed by a quenching operation.

* * * * *